US008133844B2

(12) United States Patent
Shirai et al.

(10) Patent No.: US 8,133,844 B2
(45) Date of Patent: Mar. 13, 2012

(54) HEAT-SENSITIVE TRANSFER IMAGE-RECEIVING SHEET

(75) Inventors: Hideyuki Shirai, Minami-ashigara (JP); Yasufumi Nakai, Minato-ku (JP)

(73) Assignee: Fujifilm Corporation, Tokyo (JP)

( * ) Notice: Subject to any disclaimer, the term of this patent is extended or adjusted under 35 U.S.C. 154(b) by 518 days.

(21) Appl. No.: 12/361,374

(22) Filed: Jan. 28, 2009

(65) Prior Publication Data

US 2009/0246424 A1 Oct. 1, 2009

(30) Foreign Application Priority Data

Jan. 30, 2008 (JP) ..... 2008-019859

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

FOREIGN PATENT DOCUMENTS

| | | | | |
|---|---|---|---|---|
| JP | 02-089690 | | * | 3/1990 |
| JP | 8-2123 | A | | 1/1996 |
| JP | 11-291647 | A | | 10/1999 |
| JP | 2006-62114 | A | | 3/2006 |
| JP | 2006-88691 | A | | 4/2006 |
| JP | 2006-264091 | A | | 10/2006 |
| JP | 2006-264092 | A | | 10/2006 |
| JP | 2007-160885 | A | | 6/2007 |

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet having a heat insulation layer containing hollow polymer particles, and at least two layers of receptor layers, coated in this order on one surface of a support, the receptor layer nearest from the support containing hollow polymer particles and a latex polymer, and the receptor layer furthest from the support containing no hollow polymer particles but a latex polymer.

8 Claims, No Drawings

HEAT-SENSITIVE TRANSFER IMAGE-RECEIVING SHEET

FIELD OF THE INVENTION

The present invention relates to a heat-sensitive transfer image-receiving sheet, and in more detail, it relates to a heat-sensitive transfer image-receiving sheet that causes neither white spots at a low density portion nor deterioration of color definition in the state of storage after printing.

BACKGROUND OF THE INVENTION

In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities.

In recent years, because an acceleration of a printer can shorten user's waiting time in the case where print is conducted in a photo shop for user's advantage, high-speed printers in the sublimation-type thermal transfer recording system, which can provide a print in a short time, have been developed and commercialized one after another.

In wide spread use of the printers in the sublimation-type thermal transfer recording system, there is a demand for a printer providing prints at good image quality under various environmental conditions without depending on an installation site. That is, in order to satisfy user's needs, it is necessary to provide a print good in image quality and free from image defect, not only under the standard air-conditioned environmental condition of offices and shops at a temperature of 23° C. to 27° C. and a humidity of 50% to 70%, but also, for example; under a high-temperature high-humidity condition in summer (e.g., temperature: 35° C., humidity: 80%) and a low-temperature low-humidity condition in winter (e.g., temperature: 10° C., humidity: 20%).

Recently, heat-sensitive transfer image-receiving sheets in which a receptor layer contains latex that is an aqueous dispersion of a thermoplastic resin have been proposed. That these image-receiving sheets provide excellent print properties including a proper sensitivity and absence of white spot (white spot by printing-failure in the solid image) is disclosed (see, e.g., JP-A-8-2123 ("JP-A" means unexamined published Japanese patent application), JP-A-2006-264092, JP-A-2007-160885 and JP-A-2006-88691). As a means for applying resistance to the white spot, there are disclosed a method in which a heat insulation layer, that is free of a resin having a poor resistance to an organic solvent, and a receptor layer are formed by the simultaneous multilayer coating (see, e.g., JP-A-2007-160885), and a method in which a heat insulation layer and a layer adjacent to the heat insulation layer on the receptor layer side are formed by the simultaneous multilayer coating (see, e.g., JP-A-2006-88691). Further, a method in which a heat insulation layer is formed by coating so that the heat insulation layer has a laminated structure including at least two layers is also proposed (see, e.g., JP-A-2006-62114).

However, these previous heat-sensitive transfer image-receiving sheets cause such a problem that even though an excellent image quality of print can be obtained under the standard conditions of, for example, temperature 25° C. and humidity 60%, the white spot at a low density portion remarkably arises under the conditions of low temperature and low humidity, for example, temperature 15° C. and humidity 20%. Further, they cause such a problem that uneven density owing to a transfer failure at a high density portion arises under the conditions of high temperature and high humidity. Accordingly, it has been earnestly desired to dissolve the aforementioned problems so that an excellent print can be provided under the various environmental conditions.

SUMMARY OF THE INVENTION

The present invention resides in a heat-sensitive transfer image-receiving sheet comprising a heat insulation layer containing hollow polymer particles, and at least two layers of receptor layers, coated in this order on one surface of a support, the receptor layer nearest from the support containing hollow polymer particles and a latex polymer, and the receptor layer furthest from the support containing no hollow polymer particles but a latex polymer.

Other and further features and advantages of the invention will appear more fully from the following description.

DETAILED DESCRIPTION OF THE INVENTION

According to the present invention, there is provided the following means:

(1) A heat-sensitive transfer image-receiving sheet comprising a heat insulation layer containing hollow polymer particles, and at least two layers of receptor layers, coated in this order on one surface of a support, the receptor layer nearest from the support containing hollow polymer particles and a latex polymer, and the receptor layer furthest from the support containing no hollow polymer particles but a latex polymer.

(2) The heat-sensitive transfer image-receiving sheet as described in (1), wherein the receptor layer nearest from the support is adjacent to the heat insulation layer.

(3) The heat-sensitive transfer image-receiving sheet as described in (1) or (2), wherein the solid content by mass of the hollow polymer particles contained in the heat insulation layer is in the range of 75% to 95% of the total solid content by mass of the heat insulation layer, and the solid content by mass of the hollow polymer particles contained in the receptor layer nearest from the support is in the range of 10% to 70% of the total solid content by mass of the receptor layer.

(4) The heat-sensitive transfer image-receiving sheet as described in any one of (1) to (3), wherein the average particle size of the hollow polymer particles contained in the heat insulation layer is in the range of 0.1 μm to 3.0 μm, and the average particle size of the hollow polymer particles contained in the receptor layer nearest from the support is in the range of 0.6 μm to 5.0 μm.

(5) The heat-sensitive transfer image-receiving sheet as described in any one of (1) to (4), wherein the receptor layer furthest from the support contains vinyl chloride-based latex copolymer, and the glass transition temperature (Tg) of a resin forming the latex polymer is in the range of 15° C. to 65° C., the latex polymer being contained in the receptor layer nearest from the support.

(6) The heat-sensitive transfer image-receiving sheet as described in any one of (1) to (5), wherein the ratio of the solid content by mass of hollow polymer particles/latex polymer in the receptor layer nearest from the support is in the range of 0.1 to 3.5.

(7) The heat-sensitive transfer image-receiving sheet as described in any one of (1) to (6), wherein each of the heat insulation layer, the receptor layer nearest from the support and the receptor layer furthest from the support contains a water-soluble polymer.

(8) The heat-sensitive transfer image-receiving sheet as described in any one of (1) to (7), wherein the solid content by mass of the water-soluble polymer contained in the heat insulation layer is in the range of 2% to 50% of the total solid content by mass of the heat insulation layer, the solid content by mass of the water-soluble polymer contained in the receptor layer nearest from the support is in the range of 0.2% to 10% of the total solid content by mass of the receptor layer, and the solid content by mass of the water-soluble polymer contained in the receptor layer furthest from the support is in the range of 0.1% to 3.0% of the total solid content by mass of the receptor layer.

The present invention is explained in detail below.

The heat-sensitive transfer image-receiving sheet of the present invention (hereinafter also referred to as "the image-receiving sheet of the present invention") preferably has, on a support, at least two receptor layers (hereinafter also referred to as "ink receptor layer" or "dye receptor layer"), which layers contain receptor polymers capable of receiving ink transferred from a heat-sensitive transfer sheet, and at least one heat insulation layer between the support and the receptor layer. Further, between the support and the receptor layer, there may be formed an intermediate layer having various functions such as white back ground controlling, antistatic, adhesion, and leveling functions. Further, a releasing layer may be formed at the outermost layer on the side of which a heat-sensitive transfer sheet is superposed.

Producing of the heat-sensitive transfer image-receiving sheet of the present invention may be performed by an ordinary method such as roll coating, bar coating, gravure coating, gravure reverse coating, die coat, slide coat, or curtain coat. Each of the layers in the heat-sensitive transfer image-receiving sheet of the present invention may be individually coated. Alternatively, a combination of any of these layers may be applied by simultaneous multilayer coating.

On the side of the support opposite to the receptor layer coating side, a curl adjusting layer, a recording layer or a static adjusting layer may be disposed.

(Receptor Layer)

<Latex Polymer>

In the present invention, at least two receptor layers each contain latex polymer.

The latex polymer is generally a dispersion of fine particles of thermoplastic resin in a water-soluble dispersion medium. Examples of the thermoplastic resins used for the latex polymer according to the present invention include polycarbonates, polyesters, polyacrylates, vinyl chloride copolymers, polyurethane, styrene-acrylonitrile copolymers, polycaprolactone and the like.

Among them, polycarbonates, polyesters, and vinyl chloride copolymers are preferable, polyesters and vinyl chloride copolymer are particularly preferable, and vinyl chloride copolymer is most preferable.

The polyester is prepared by condensation of a dicarboxylic acid derivative and a diol compound, and may include an aromatic ring and/or a saturated carbon ring as well as a water-soluble group for imparting dispersibility thereto.

The vinyl chloride copolymer is a copolymer prepared with vinyl chloride as the polymerization monomer and other monomers, and examples thereof include vinyl chloride-vinyl acetate copolymers, vinyl chloride-acrylate copolymers, vinyl chloride-methacrylate copolymers, vinyl chloride-vinyl acetate-acrylate copolymers, and vinyl chloride-acrylate-ethylene copolymers. As described above, the copolymer may be a binary copolymer or a ternary or higher copolymer, and the monomers may be distributed randomly or uniformly by block copolymerization.

The copolymer may contain an auxiliary monomer component such as vinylalcohol derivatives, maleic acid derivatives, and vinyl ether derivatives. The copolymer preferably contain the vinyl chloride component in an amount of 50 mass % or more, and the auxiliary monomer component such as maleic acid derivative and vinyl ether derivative in an amount of 10 mass % or less.

The latex polymers may be used alone or as a mixture. The latex polymer may have a uniform structure or a core/shell structure, and in the latter case, the resins constituting the core and shell respectively may have different glass transition temperatures.

Examples of acrylate latex include Nipol LX814 (Tg 25° C.), and Nipol LX857 (Tg 43° C.) (each trade name, manufactured by Nippon Zeon). Examples of polyester latex include VYRONAL MD-1100 (Tg 40° C.), VYRONAL MD-1400 (Tg 20° C.), VYRONAL MD-1480 (Tg 20° C.), VYRONAL MD-1985 (Tg 20° C.), VYRONAL MD-1200 (Tg 67° C.), VYRONAL MD-1245 (Tg 61° C.), VYRONAL MD-1500 (Tg 77° C.) (each trade name, manufactured by Toyobo), PLASCOAT Z-850 (Tg 20° C.), PLASCOAT Z-450 (Tg 55° C.), PLASCOAT Z-561 (Tg 64° C.) (each trade name, manufactured by GOO CHEMICAL), ELITEL KZA134 (Tg 40° C.), and ELITEL KA5034 (Tg 67° C.) (each trade name, manufactured by UNITIKA). Examples of vinyl chloride copolymer latex include VINYBLAN 276 (Tg 33° C.), VINYBLAN 609 (Tg 46° C.), VINYBLAN 690 (Tg 46° C.), VINYBLAN 603 (Tg 64° C.), VINYBLAN 900 (Tg 70° C.), VINYBLAN 683 (Tg 72° C.) (each trade name, manufactured by Nisshin Chemical), Sumielite 1320 (Tg 30° C.), and Sumielite 1210 (Tg 20° C.) (each trade name, manufactured by Sumika Chemtex).

As an amount of the latex polymer contained in the receptor layer furthest from the support, the solid content by mass of the latex polymer is preferably in the range of 50% to 98%, and more preferably from 70% to 95% of the total solid content by mass of the receptor layer.

The glass transition temperature (Tg) of the latex polymer contained in the receptor layer furthest from the support is preferably in the range of 10° C. to 100° C., more preferably from 20° C. to 90° C., and furthermore preferably from 30° C. to 85° C.

As an amount of the latex polymer contained in the receptor layer nearest from the support, the solid content by mass of the latex polymer is preferably in the range of 40% to 90%, and more preferably from 50% to 80% of the total solid content by mass of the receptor layer.

The glass transition temperature (Tg) of the latex polymer contained in the receptor layer nearest from the support is preferably in the range of 15° C. to 65° C., more preferably from 20° C. to 60° C., and furthermore preferably from 25° C. to 55° C.

<Water-Soluble Polymer>

In the heat-sensitive transfer image-receiving sheet of the present invention, the receptor layer can contain a water-soluble polymer. It is preferred all receptor layers contain a water-soluble polymer.

Herein, "water-soluble polymer" means a polymer which dissolves, in 100 g water at 20° C., in an amount of preferably 0.05 g or more, more preferably 0.1 g or more, further preferably 0.5 g or more, and particularly preferably 1 g or more.

As the water-soluble polymers, natural polymers, semi-synthetic polymers and synthetic polymers are preferably used.

When the water-soluble polymers are used in the heat-sensitive transfer image-receiving sheet, it is preferable that the water-soluble polymers are cross-linked with a hardening agent added to the heat-sensitive transfer image-receiving sheet. It is noted that the water-soluble polymers are required to be capable of reacting with the hardening agent, thereby to cross-link. Specifically, the water-soluble polymer has a reacting group (for example, a group having —OH group, >NH group, or —SH group, so-called a group having an active hydrogen) that reacts with a double bond or an active halide that releases a halide upon a nucleophilic reaction.

Among the water-soluble polymers which can be used in the heat-sensitive transfer image-receiving sheet of the present invention, the natural polymers and the semi-synthetic polymers will be explained in detail. Specific examples include the following polymers: plant type polysaccharides such as κ-carrageenans, ι-carrageenans, λ-carrageenans, and pectins; microbial type polysaccharides such as xanthan gums and dextrins; animal type natural polymers such as gelatins, caseins; and cellulose-based polymers such as carboxymethylcelluloses, hydroxyethylcelluloses, and hydroxypropylcelluloses.

Among these, gelatin is preferable. Gelatin having a molecular weight of from 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

Of the water-soluble polymers that can be used in the heat-sensitive transfer image-receiving sheet of the present invention, examples of the synthetic polymers include polyvinyl pyrrolidone, polyvinyl pyrrolidone copolymers, polyvinyl alcohol, polyethylene glycol, polypropylene glycol, and water-soluble polyesters.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-10, PVA-117 and PVA-117H (trade names, manufactured by KURARAY CO., LTD.); partially saponificated polyvinyl alcohol such as PVA-203, PVA-205, PVA-210 and PVA-220 (trade names, manufactured by KURARAY CO., LTD.); and modified polyvinyl alcohols such as C-118, HL-12E, KL-118 and MP-203 (trade names, manufactured by KURARAY CO., LTD.).

The solid content by mass of the water-soluble polymer contained in the receptor layer nearest from the support is preferably in the range of 0.2% to 10%, and more preferably from 0.5% to 3% of the total solid content by mass of the receptor layer.

The solid content by mass of the water-soluble polymer contained in the receptor layer furthest from the support is preferably in the range of 0.1% to 3%, and more preferably from 0.2% to 2% of the total solid content by mass of the receptor layer.

<Hollow Polymer Particles>

In the heat-sensitive transfer image-receiving sheet of the present invention, the receptor layer nearest from the support contains hollow polymer particles. It is preferable that the receptor layer nearest from the support is adjacent to a heat insulation layer in order to make the function of the heat insulation layer effective.

The solid content by mass of the hollow polymer particles contained in the receptor layer nearest from the support is preferably in the range of 10% to 70%, and more preferably from 20% to 50% of the total solid content by mass of the receptor layer.

The average particle size of the hollow polymer particles contained in the receptor layer nearest from the support is preferably in the range of 0.6 μm to 5.0 μm, more preferably from 0.6 μm to 4.0 μm, furthermore preferably from 0.6 μm to 3.0 μm, and particularly preferably from 0.7 μm or more.

Details of the hollow polymer particles will be explained in the section of the heat insulation layer. The hollow polymer particles used in the receptor layer may be the same as or different from that of the heat insulation layer. Further, two or more hollow polymer particles different from each other may be used in combination.

The ratio of the solid content by mass of hollow polymer particles/latex polymer in the receptor layer nearest from the support is preferably in the range of 0.1 to 3.5, more preferably from 0.15 to 2.0, and furthermore preferably from 0.2 to 1.0.

<Surfactant>

Further, in the heat-sensitive transfer image-receiving sheet of the present invention, a surfactant may be contained in any of such layers as described above.

In the layer to which the surfactant is added, an addition amount of the surfactant is preferably from 0.01% by mass to 5% by mass, more preferably from 0.01% by mass to 1% by mass, and especially preferably from 0.02% by mass to 0.5% by mass, based on the total solid content.

With respect to the surfactant, various kinds of surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition on August in 2000, Chapter 6. Of these surfactants, anionic or nonionic surfactant is preferred. Anionic surfactant is more preferred.

As the surfactant, one or at least two surfactants may be used. A surfactant of one layer may be different from that of each other layer. It is preferred to use a fluorine-containing surfactant as at least one surfactant.

<Releasing Agent>

In the heat-sensitive transfer image-receiving sheet of the present invention, it is preferable to use a releasing agent in order to keep more securely the releasing property between the heat-sensitive transfer sheet and the image-receiving sheet at the time of printing images.

As the releasing agent, there can be used, for example, solid waxes such as polyethylene wax, paraffin wax, fatty acid ester wax, and amide wax; and silicone oil, phosphoric ester based compounds, fluorine based surfactants, silicone based surfactants, and other releasing agents known in this technical field. Of these releasing agents, preferred are fatty acid ester waxes, fluorine based surfactants, and silicone based compounds such as silicone based surfactants, silicone oil and/or cured products thereof.

It is preferable that the receptor layer of the heat-sensitive transfer image-receiving sheet of the present invention contains a polymer having a fluorine aliphatic group at a side chain thereof.

The polymer compound having fluorine atom-substituted aliphatic groups on its side chains can be derived from a fluoro aliphatic compound (compound having a fluorine atom-substituted aliphatic group(s) on the side chain(s)) produced by a telomerization method (also referred to as a telomer method), or an oligomerization method (also referred to as an oligomer method). The fluoro aliphatic compound can be easily synthesized by, for example, a method described in JP-A-2002-90991.

The fluorine atom-substituted aliphatic group is an aliphatic group (straight-chain, branched or cyclic aliphatic group), preferably an alkyl, alkenyl or cycloalkynyl group having 1 to 36 carbon atoms, having at least one substituted fluorine atom, more preferably an alkyl group having 1 to 36 carbon atoms (preferably 1 to 18 carbon atoms, more preferably 1 to 12 carbon atoms, furthermore preferably 1 to 10 carbon atoms, most preferably 4 to 8 carbon atoms) having at least one substituted fluorine atom. The aliphatic group may be substituted additionally with a substituent other than the fluorine atom. Examples of the substituent include alkyl groups, aryl groups, heterocyclic groups, halogen atoms other than the fluorine atom, a hydroxyl group, alkoxy groups, aryloxy groups, alkylthio groups, arylthio groups, an amino group, alkylamino groups, arylamino groups, heterocyclic amino groups, acylamino groups, sulfone amino groups, carbamoyl groups, sulfamoyl groups, a cyano group, a nitro group, acyl groups, sulfonyl groups, ureido groups, and urethane groups.

In the present invention, the fluorine atom-substituted aliphatic group is most preferably a perfluoroalkyl group.

The polymer compound having fluorine atom-substituted aliphatic group(s) on the side chains is preferably a polymer or copolymer of a fluorine atom-substituted aliphatic group-containing monomer, and examples of the monomer include acrylic acid derivatives (e.g., acrylic acids, acrylic esters, and acrylamides, preferably acrylic esters and acrylamides, more preferably acrylic esters) and methacrylic acid derivatives (e.g., methacrylic acids, methacrylic esters, and methacrylamides, preferably methacrylic esters and methacrylamides, more preferably methacrylic esters) each having an acyl, alcohol or amide moiety (a substituent bouding with nitrogen atom) substituted with a fluorine atom-substituted aliphatic group; and acrylonitrile derivatives having a fluorine atom-substituted aliphatic group.

In the case where the polymer compound having fluorine atom-substituted aliphatic groups on the side chains is a copolymer with a fluorine atom-substituted aliphatic group-containing monomer, examples of the monomer used in combination include acrylates, methacrylates, acrylonitriles, acrylamides, methacrylamides, olefins, and styrenes. Among these, acrylates, methacrylates, acrylonitriles, acrylamides, and methacrylamides are preferable; acrylates and methacrylates are more preferable; and among them, those having a polyoxyalkylene (e.g., polyoxyethylene, polyoxypropylene) unit in the group substituted on the nitrogen atom of the alcohol group or the amide moiety are preferable.

In the present invention, the polymer above is preferably a copolymer, which may be a binary copolymer or a ternary or higher copolymer.

As the polymers having a fluoro aliphatic group on the side chains, preferred are copolymers of a monomer having an aliphatic group substituted with a fluorine atom and poly(oxyalkylene)acrylate and/or poly(oxyalkylene)methacrylate. They may be random copolymers or block copolymers. Examples of the poly(oxyalkylene) group include poly(oxyethylene) group, poly(oxypropylene) group, and poly(oxybutylene) group. Further, the poly(oxyalkylene) group may be a unit having alkylene groups of chain lengths different from each other in the same chain, such as poly(block connector of oxyethylene and oxypropylene and oxyethylene) and poly(block connector of oxyethylene and oxypropylene). Further, the copolymer of a monomer having an aliphatic group substituted with a fluorine atom and poly(oxyalkylene)acrylate (or methacrylate) is not limited to binary copolymers, but may be ternary or more multiple copolymers that can be produced by copolymerizing several different co-monomers such as monomers having two or more different aliphatic groups substituted with a fluorine atom and two or more different kinds of poly(oxyalkylene)acrylate (or methacrylate).

An average molecular weight of the polymers having a fluoro aliphatic group at a side chain ranges from 5,000 to 50,000, preferably from 8,000 to 30,000, and more preferably from 10,000 to 20,000.

Examples of the copolymers include copolymers of acrylate (or methacrylate) having a perfluorobutyl group ($—C_4F_9$) and poly(oxyalkylene)acrylate (or methacrylate); copolymers of acrylate (or methacrylate) having a perfluorobutyl group, poly(oxyethylene)acrylate (or methacrylate) and poly(oxypropylene)acrylate (or methacrylate); copolymers of acrylate (or methacrylate) having a perfluorohexyl group ($—C_6F_{13}$) and poly(oxyalkylene)acrylate (or methacrylate); copolymers of acrylate (or methacrylate) having a perfluorohexyl group, poly(oxyethylene)acrylate (or methacrylate) and poly(oxypropylene)acrylate (or methacrylate); copolymers of acrylate (or methacrylate) having a perfluorooctyl group ($—C_8F_{17}$) and poly(oxyalkylene)acrylate (or methacrylate); and copolymers of acrylate (or methacrylate) having a perfluorooctyl group, poly(oxyethylene)acrylate (or methacrylate) and poly(oxypropylene)acrylate (or methacrylate).

Further, the polymers having a fluoro aliphatic group at a side chain are commercially available referring to a general name such as "perfluoroalkyl-containing oligomers". For example, the following products can be used. As the products of Dainippon Ink & Chemicals Incorporated, there are Megafac F-470, Megafac F-471, Megafac F-472SF, Megafac F-474, Megafac F-475, Megafac F-477, Megafac F-478, Megafac F-479, Megafac F-480SF, Megafac F-472, Megafac F-483, Megafac F-484, Megafac F-486, Megafac F-487, Megafac F-489, Megafac F-172D, Megafac F-178K, Megafac F-178RM (each product name). As the products of Sumitomo 3 M Limited, there are Novec™ FC-4430 and FC-4432 (each product name).

The polymer compound having aliphatic groups substituted with a fluorine atom on its side chains is preferably a nonionic compound (having no dissociable group in water such as sulfo group and carboxyl group), and more preferably water-soluble to a certain degree. The phrase "water soluble to a certain degree" means that the polymer compound has solubility in pure water of 1% or more at 25° C. Specifically, the polymer is, for example, a polymer compound having a hydroxyl group(s) and/or the oxyalkylene group(s) described above. Favorable examples thereof include water-soluble compounds such as Megafac F-470, Megafac F-472SF, Megafac F-477, Megafac F-479, Megafac F-480SF, Megafac F-484, and Megafac F-486 (all trade names, manufactured by Dainippon Ink & Chemicals Incorporated).

In the resent invention, the reason why the polymer having an aliphatic group(s) substituted with a fluorine atom on its side chain(s) is preferably nonionic and soluble in water to a certain degree is not yet to be understood, but is likely the followings: A nonionic polymer having an aliphatic group(s) substituted with a fluorine atom on its side chain(s) has strong affinity for the dye and the receiving polymer after thermal transfer, and it is also has moderate affinity for the layer of the heat-sensitive transfer image-receiving sheet prepared by using latex because of its water solubility. Therefore, the nonionic polymer bleeds out into the interface between the heat-sensitive transfer sheet and the heat-sensitive transfer image-receiving sheet during printing under high-temperature and high-humidity condition, exhibiting its effective releasing action.

The addition amount of the polymer compound having aliphatic groups substituted with a fluorine atom on its side chains is 0.2% to 10%, preferably 0.5% to 8% and more preferably 1% to 5%, with respect to the total solid content (mass) in the receptor layer. Although use of only one kind of polymer compound having aliphatic groups substituted with a fluorine atom on its side chains alone is effective, use of two or more kinds of polymers above is more effective.

<Matting Agent>

To the heat-sensitive transfer image-receiving sheet of the present invention, a matting agent may be added in order to prevent blocking, or to give a release property or a sliding property. The matting agent may be added on the same side as the coating side of the receptor layer, or on the side opposite to the coating side of the receptor layer, or on both sides.

Examples of the matting agent generally include fine particles of water-insoluble organic compounds and fine particles of water-insoluble inorganic compounds. In the present invention, the organic compound-containing fine particles are preferably used from the view point of dispersion properties. In so far as the organic compound is incorporated in the particles, there may be organic compound particles consisting of the organic compound alone, or alternatively organic/inorganic composite particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

<Antiseptics>

To the heat-sensitive transfer image-receiving sheet of the present invention, antiseptics may be added. The antiseptics that may be used in the image-receiving sheet of the invention are not particularly limited. For example, use can be made of materials described in Bofubokabi (Preservation and Antifungi) HAND BOOK, Gihodo Shuppan (1986), Bokin Bokabi no Kagaku (Chemistry of Anti-bacteria and Antifungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

The coating amount of all the receptor layers is preferably 0.5 to 10 g/m$^2$ (solid basis, hereinafter, the amount to be applied in the present specification means a numerical value on solid basis, unless otherwise specified). The film thickness of all the receptor layers is preferably in the range of 1 μm to 20 μm.

(Heat Insulation Layer)

The heat insulation layer that is coated in the heat-sensitive transfer image-receiving sheet of the present invention may be a single layer or double or more multiple layers. The heat insulation layer is disposed between the support and the receptor layer.

In the heat-sensitive transfer image-receiving sheet of the present invention, the heat insulation layer contains hollow polymer particles.

The hollow polymer particles in the present invention are polymer particles having closed cells inside of the particles. The hollow polymer particles are preferably latex polymer. Examples of the hollow polymer particles include (1) non-foaming type hollow particles obtained in the following manner: a dispersion medium such as water is contained inside of a capsule wall formed of a polystyrene, acrylic resin, or styrene/acrylic resin, and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

As the hollow polymer particles that be used in the present invention, non-foaming hollow polymer particles of the foregoing (1) are preferred. If necessary, use can be made of a mixture of two or more kinds of polymer particles. Specific examples of the above (1) include Rohpake HP-1055, manufactured by Rohm and Haas Co.; SX866(B), manufactured by JSR Corporation; and Nippol MH5055, manufactured by Nippon Zeon (all of these product names are trade names).

The solid content by mass of the hollow polymer particles contained in the heat insulation layer is preferably in the range of 70% to 95%, and more preferably from 75% to 90% of the total solid content by mass of the heat insulation layer.

The average particle diameter (particle size) of the hollow polymer particles is preferably 0.1 to 3.0 μm, more preferably 0.2 to 2.0 μm, and particularly preferably 0.3 to 0.8 μm.

In the present invention, the particle size of the hollow polymer particle is calculated after measurement of the circle-equivalent diameter of the periphery of particle under a transmission electron microscope. The average particle diameter is determined by measuring the circle-equivalent diameter of the periphery of at least 300 hollow polymer particles observed under the transmission electron microscope and obtaining the average thereof.

The hollow (void) ratio of the hollow polymer particles is calculated by the ratio of the volume of voids to the volume of a particle.

It is preferred that the heat insulation layer contains a water-soluble polymer as a binder in addition to hollow polymer particles. A preferable water-soluble polymer is exemplified by water-soluble polymers described in the section of Receptor layer. Among these water-soluble polymers, gelatin and a polyvinyl alcohol are more preferable. These resins may be used either singly or as a mixture thereof.

A thickness of the heat insulation layer containing the hollow polymer particles is preferably from 5 to 50 μm, more preferably from 5 to 40 μm.

To the heat insulation layer, the aforementioned water-soluble polymers that can be added to the receptor layer may be added. The same water-soluble polymers as or different water-soluble polymers from those of the receptor layer may be used in the heat insulation layer. These water-soluble polymers may be used in any combination and any proportion. As the water-soluble polymer, polyvinyl alcohol or gelatin is preferable. Gelatin is most preferable.

The solid content by mass of the water-soluble polymer contained in the heat insulation layer is preferably in the range of 2% to 50%, more preferably from 5% to 30% and further more preferably from 10% to 20% of the total solid content by mass of the heat insulation layer.

(Intermediate Layer)

Further, there may be formed an intermediate layer having various functions such as white back ground controlling, antistatic, adhesion, and leveling functions between the support and the receptor layer. The function of the intermediate layer is not limited to these, and a previously known intermediate layer may be provided. In the heat-sensitive transfer image-receiving sheet of the present invention, it is preferable that an intermediate layer is formed between a support and a heat insulation layer nearest from the support.

In the heat-sensitive transfer image-receiving sheet of the present invention, it is preferable that an intermediate layer contains latex polymer.

The glass transition temperature (Tg) of the latex polymer contained in the heat insulation layer is preferably in the range of −40° C. to 40° C., more preferably from −30° C. to 30° C., and furthermore preferably from −20° C. to 20° C.

In the heat-sensitive transfer image-receiving sheet of the present invention, examples of preferable latex polymer include acrylic latex, polyester-based latex, styrene/butadiene-based latex, methylmethacrylate/butadiene-based latex, polyurethane-based latex, and vinyl chloride-based latex. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

Of these, styrene/butadiene-based latex, methylmethacrylate/butadiene-based latex, and polyurethane-based latex are preferable. Methylmethacrylate/butadiene-based latex and polyurethane-based latex are especially preferable.

Specific examples of the styrene/butadiene-based latex include Nipol LX421, Nipol LX430, Nipol LX435, and Nipol LX438C (each trade name, manufactured by Nippon Zeon), SR-103, SR-104, SR-108, and SR-140, SR-141 (each trade name, manufactured by Nippon A&L Inc.).

Specific examples of the methylmethacrylate/butadiene-based latex include MR-170, MR-171, MR-173, and MR-180 (each trade name, manufactured by Nippon A & L Inc.).

Specific examples of the polyurethane-based latex include HYDRAN AP-10, AP-20, AP-30, and AP-40 (each trade name, manufactured by Dainippon Ink & Chemicals Inc.), WBR-016U, WBR-2018, WBR-2019 (each trade name, manufactured by Taisei Fine Chemical), and NS-310X (trade name, manufactured by TAKAMATSU OIL & FAT).

In the heat-sensitive transfer image-receiving sheet of the present invention, the aforementioned water-soluble polymer may be added to the intermediate layer.

(Hardener)

As the cross-linking agent that can be used in the image-receiving sheet of the present invention, a hardener (hardening agent) may be added in coating layers (e.g., the receptor layer, the heat insulation layer, the intermediate layer) of the image-receiving sheet.

Preferable examples of the hardener that can be used in the present invention include H-1, 4, 6, 8, and 14 in JP-A-1-214845 in page 17; compounds (H-1 to H-54) represented by one of the formulae (VII) to (XII) in U.S. Pat. No. 4,618,573, columns 13 to 23; compounds (H-1 to H-76) represented by the formula (6) in JP-A-2-214852, page 8, the lower right (particularly, H-14); and compounds described in claim 1 in U.S. Pat. No. 3,325,287. Examples of the hardening agent include hardening agents described, for example, in U.S. Pat. No. 4,678,739, column 41, U.S. Pat. No. 4,791,042, JP-A-59-116655, JP-A-62-245261, JP-A-61-18942, and JP-A-4-218044. More specifically, an aldehyde-based hardening agent (formaldehyde, etc.), an aziridine-based hardening agent, an epoxy-based hardening agent, a vinyl sulfone-based hardening agent (N,N'-ethylene-bis(vinylsulfonylacetamido) ethane, etc.), an N-methylol-based hardening agent (dimethylol urea, etc.), a boric acid, a metaboric acid, or a polymer hardening agent (compounds described, for example, in JP-A-62-234157), can be mentioned.

Preferable examples of the hardener include a vinylsulfone-based hardener and chlorotriazines.

More preferable hardeners in the present invention are compounds represented by the following Formula (A) or (B).

$$(CH_2{=}CH{-}SO_2)_n\text{-}L \qquad \text{Formula (A)}$$

$$(X{-}CH_2{-}CH_2{-}SO_2)_n\text{-}L \qquad \text{Formula (B)}$$

In formulae (A) and (B), X represents a halogen atom, L represents an organic linking group having n-valency. When the compound represented by formula (A) or (B) is a low-molecular compound, n denotes an integer from 1 to 4. When the compound represented by formula (A) or (B) is a high-molecular (polymer) compound, L represents an organic linking group containing a polymer chain and n denotes an integer ranging from 10 to 1,000.

In the Formulae (A) and (B), X is preferably a chlorine atom or a bromine atom, and further preferably a bromine atom. n is an integer from 1 to 4, preferably an integer from 2 to 4, more preferably 2 or 3 and most preferably 2.

L represents an organic group having n-valency, and preferably an aliphatic hydrocarbon group, an aromatic hydrocarbon group or a heterocyclic group, provided that these groups may be combined through an ether bond, ester bond, amide bond, sulfonamide bond, urea bond, urethane bond or the like. Also, each of these groups may be further substituted. Examples of the substituent include a halogen atom, alkyl group, aryl group, heterocyclic group, hydroxyl group, alkoxy group, aryloxy group, alkylthio group, arylthio group, acyloxy group, alkoxycarbonyl group, carbamoyloxy group, acyl group, acyloxy group, acylamino group, sulfonamide group, carbamoyl group, sulfamoyl group, sulfonyl group, phosphoryl group, carboxyl group and sulfo group. Among these groups, a halogen atom, alkyl group, hydroxy group, alkoxy group, aryloxy group and acyloxy group are preferable.

Specific examples of the vinylsulfone-based hardener include, though not limited to, the following compounds (VS-1) to (VS-27).

$CH_2{=}CH{-}SO_2{-}CH_2{-}SO_2{-}CH{=}CH_2$ (VS-1)

$CH_2{=}CH{-}SO_2{-}CH_2CH_2{-}SO_2{-}CH{=}CH_2$ (VS-2)

$CH_2{=}CH{-}SO_2{-}CH_2CH_2CH_2{-}SO_2{-}CH{=}CH_2$ (VS-3)

$CH_2{=}CH{-}SO_2{-}CH_2CH(CH_3)CH_2{-}SO_2{-}CH{=}CH_2$ (VS-4)

$CH_2{=}CH{-}SO_2{-}CH_2OCH_2{-}SO_2{-}CH{=}CH_2$ (VS-5)

$CH_2{=}CH{-}SO_2{-}CH_2CH_2OCH_2CH_2{-}SO_2{-}CH{=}CH_2$ (VS-6)

$CH_2{=}CH{-}SO_2{-}CH_2C(=O)NHCH_2CH_2NHC(=O)CH_2{-}SO_2{-}CH{=}CH_2$ (VS-7)

$CH_2{=}CH{-}SO_2{-}CH_2C(=O)NHCH_2CH_2CH_2NHC(=O)CH_2{-}SO_2{-}CH{=}CH_2$ (VS-8)

$CH_2{=}CH{-}SO_2{-}CH_2CH(OH)CH_2{-}SO_2{-}CH{=}CH_2$ (VS-9)

$CH_2{=}CH{-}SO_2{-}CH_2CH(OH)CH(OH)CH_2{-}SO_2{-}CH{=}CH_2$ (VS-10)

$CH_2{=}CH{-}SO_2{-}CH_2CH(OH)CH_2CH_2{-}SO_2{-}CH{=}CH_2$ (VS-11)

$CH_2{=}CH{-}SO_2{-}CH_2CH(OH)CH_2CH(OH)CH_2{-}SO_2{-}CH{=}CH_2$ (VS-12)

$CH_2{=}CH{-}SO_2{-}CH_2CH(OH)CH_2CH_2CH(OH)CH_2{-}SO_2{-}CH{=}CH_2$ (VS-13)

$CH_2{=}CH{-}SO_2{-}CH_2CH(OH)CH_2CH(OH)CH_2CH(OH)CH_2{-}SO_2{-}CH{=}CH_2$ (VS-14)

$CH_2{=}CH{-}SO_2{-}CH_2CH(OH)CH_2OCH_2CH(OH)CH_2{-}SO_2{-}CH{=}CH_2$ (VS-15)

$CH_2{=}CH{-}SO_2{-}CH_2CH(OH)CH_2C(=O)CH_2CH(OH)CH_2{-}SO_2{-}CH{=}CH_2$ (VS-16)

$CH_2{=}CH{-}SO_2{-}CH_2CH(OH)CH_2N(H)CH_2CH(OH)CH_2{-}SO_2{-}CH{=}CH_2$ (VS-17)

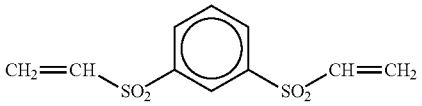

(VS-18)

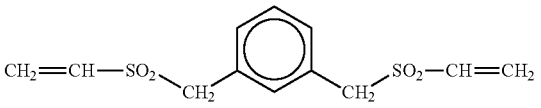

-continued (VS-19)

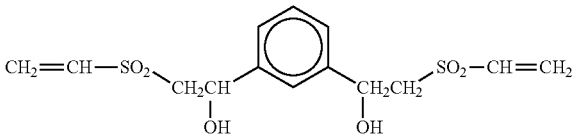

(VS-20)

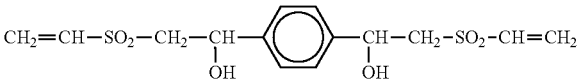

(VS-21)

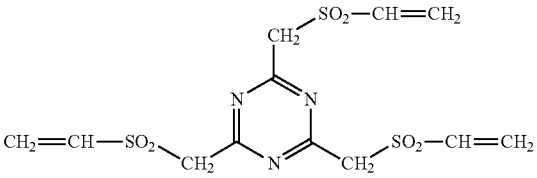

(VS-22)

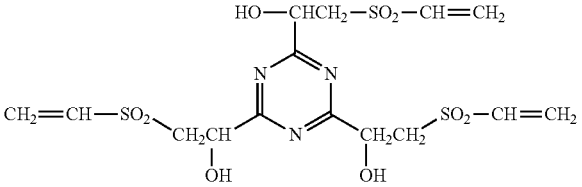

(VS-23)

$Cl{-}CH_2{-}CH_2{-}SO_2{-}CH_2{-}SO_2{-}CH_2{-}CH_2{-}Cl$ (VS-24)

$Br{-}CH_2{-}CH_2{-}SO_2{-}CH_2{-}SO_2{-}CH_2{-}CH_2{-}Br$ (VS-25)

$Br{-}CH_2{-}CH_2{-}SO_2{-}CH_2OCH_2{-}SO_2{-}CH_2{-}CH_2{-}Br$ (VS-26)

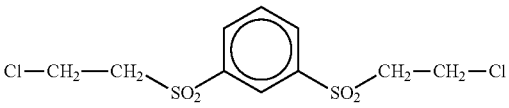

(VS-27)

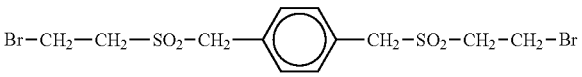

These hardeners may be obtained with reference to the method described in, for example, the specification of U.S. Pat. No. 4,173,481.

Furthermore, as the chlorotriazine-based hardener, a 1,3,5-triazine compound in which at least one of the 2-position, 4-position and 6-position of the triazine ring in the compound is substituted with a chlorine atom, is preferable. A 1,3,5-triazine compound in which two or three of the 2-position, 4-position and 6-position of the triazine ring each are substituted with a chlorine atom, is more preferable. Alternatively, use may be made of a 1,3,5-triazine compound in which at least one of the 2-position, 4-position and 6-position of the triazine ring is substituted with a chlorine atom, and the remainder position(s) is/are substituted with a group(s) or atom(s) other than a chlorine atom. Examples of these other groups include a hydrogen atom, bromine atom, fluorine atom, iodine atom, alkyl group, alkenyl group, alkynyl group, cycloalkyl group, cycloalkenyl group, aryl group, heterocyclic group, hydroxy group, nitro group, cyano group, amino group, hydroxylamino group, alkylamino group, arylamino group, heterocyclic amino group, acylamino group, sulfonamide group, carbamoyl group, sulfamoyl group, sulfo group, carboxyl group, alkoxy group, alkenoxy group, aryloxy group, heterocyclic oxy group, acyl group, acyloxy group, alkyl- or aryl-sulfonyl group, alkyl- or aryl-sulfinyl group, alkyl- or aryl sulfonyloxy group, mercapto group, alkylthio group, alkenylthio group, arylthio group, heterocyclic thio group and alkyloxy- or aryloxy-carbonyl group.

Specific examples of the chlorotriazine-based hardener include, though not limited to, 4,6-dichloro-2-hydroxy-1,3,5-triazine or its Na salt, 2-chloro-4,6-diphenoxytriazine, 2-chloro-4,6-bis[2,4,6-trimethylphenoxy]triazine, 2-chloro-4,6-diglycidoxy-1,3,5-triazine, 2-chloro-4-(n-butoxy)-6-glycidoxy-1,3,5-triazine, 2-chloro-4-(2,4,6-trimethylphenoxy)-6-glycidoxy-1,3,5-triazine, 2-chloro-4-(2-chloroethoxy)-6-(2,4,6-trimethylphenoxy)-1,3,5-triazine, 2-chloro-4-(2-bromoethoxy)-6-(2,4,6-trimethylphenoxy)-1,3, 5-triazine, 2-chloro-4-(2-di-n-butylphosphateethoxy)-6-(2,4,6-trimethylphenoxy)-1,3,5-triazine and 2-chloro-4-(2-di-n-butylphosphateethoxy)-6-(2,6-xylenoxy)-1,3,5-triazine.

Such a compound can be easily produced by reacting cyanur chloride (namely, 2,4,6-trichlorotriazine) with, for example, a hydroxy compound, thio compound or amino compound corresponding to the substituent on the heterocycle.

These hardeners are preferably used in an amount of 0.001 to 1 g, and further preferably 0.005 to 0.5 g, per 1 g of the water-soluble polymer.

(Curl Adjusting Layer)

In the heat-sensitive transfer image-receiving sheet that is used in the present invention, if necessary, a curl adjusting layer is preferably formed. For the curl adjusting layer, a polyethylene laminate, a polypropylene laminate or the like is used. Specifically, the curl adjusting layer may be formed in a manner similar to those described in, for example, JP-A-61-110135 and JP-A-6-202295.

(Writing Layer and Charge Controlling Layer)

In the heat-sensitive transfer image-receiving sheet that is used in the present invention, if necessary, a writing layer or a charge controlling layer may be disposed. For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

(Support)

As the support that be used in the image-receiving sheet of the present invention, any known support can be used. Among these, waterproof support can be preferably used. The use of the waterproof support makes it possible to prevent the support from absorbing moisture, whereby a fluctuation in the performance of the receptor layer with time can be prevented. As the waterproof support, for example, coated paper, laminate paper or synthetic paper may be used.

(Heat-Sensitive Transfer Sheet)

The heat-sensitive transfer sheet has a support substrate and a heat transfer layer containing a diffusion transfer dye (hereinafter, referred to as heat transfer layer or dye layer) formed thereon, and preferably has an additional transfer protective-layer laminate, for forming a protective layer of a transparent resin on the thermally transferred image and thus covering and protecting the image formed on the same support.

In the heat-sensitive transfer sheet, preferably, heat transfer layers (hereinafter also referred to as "heat-sensitive transfer layers" or "dye layers") in individual colors of yellow, magenta and cyan, and an optional heat transfer layer in black are repeatedly provided onto a single support in area order in such a manner that the colors are divided from each other. An example of the heat transfer layers is an embodiment wherein heat transfer layers in individual colors of yellow, magenta and cyan are provided onto a single support in the longitudinal direction of the support in area order, correspondingly to the area of the recording surface of the above-mentioned heat-sensitive transfer image-receiving sheet, in such a manner that the colors are divided from each other. In addition to the three layers above, it may have a black heat transfer layer. In addition, the heat-sensitive transfer sheet preferably has a mark indicating the start point of each of various colors allowing recognition by the printer used.

In the present invention, the heat transfer layer contains at least a sublimation type dye and a binder resin. The heat transfer layer may contain waxes, silicone resins, polymer particles or inorganic particles, in accordance with necessity.

Each dye in the heat transfer layer is preferably contained in an amount of 20 to 80 mass % of the heat transfer layer, preferably in that of 30 to 70 mass % thereof.

The coating of the heat transfer layer (i.e., the painting of a coating solution for the dye layer) is performed by an ordinary method such as roll coating, bar coating, gravure coating, or gravure reverse coating. The coating amount of the heat transfer layer is preferably from 0.1 to 2.0 g/m$^2$, more preferably from 0.2 to 1.2 g/m$^2$ (the amount is a numerical value converted to the solid content in the layer; any coating amount in the following description is a numerical value converted to the solid content unless otherwise specified). The film thickness of the heat transfer layer is preferably from 0.1 to 2.0 μm, more preferably from 0.2 to 1.2 μm.

The dyes contained in the heat transfer layer in the present invention must be the dyes are able to diffuse by heat and able to be incorporated in a heat-sensitive transfer sheet, and able to transfer by heat from the heat-sensitive transfer sheet to an image-receiving sheet. As the dyes that are used for the heat-sensitive transfer sheet, ordinarily used dyes or known dyes can be effectively used.

Preferable examples of the dyes that is used in the present invention include diarylmethane-based dyes, triarylmethane-based dyes, thiazole-based dyes, methine-based dyes such as merocyanine; azomethine-based dyes typically exemplified by indoaniline, acetophenoneazomethine, pyrazoloazomethine, imidazole azomethine, imidazo azomethine, and pyridone azomethine; xanthene-based dyes; oxazine-based dyes; cyanomethylene-based dyes typically exemplified by dicyanostyrene, and tricyanostyrene; thiazine-based dyes; azine-based dyes; acridine-based dyes; benzene azo-based dyes; azo-based dyes such as pyridone azo, thiophene azo, isothiazole azo, pyrrol azo, pyralazo, imidazole azo, thiadiazole azo, triazole azo, and disazo; spiropyran-based dyes; indolinospiropyran-based dyes; fluoran-based dyes; rhodaminelactam-based dyes; naphthoquinone-based dyes; anthraquinone-based dyes; and quinophthalon-based dyes.

Specific examples of the yellow dyes include Disperse Yellow 231, Disperse Yellow 201 and Solvent Yellow 93. Specific examples of the magenta dyes include Disperse Violet 26, Disperse Red 60, and Solvent Red 19. Specific examples of the cyan dyes include Solvent Blue 63, Solvent Blue 36, Disperse Blue 354 and Disperse Blue 35. As a matter of course, it is also possible to use suitable dyes other than these dyes as exemplified above.

Further, dyes each having a different hue from each other as described above may be arbitrarily combined together.

Each of the heat transfer layers may have a mono-layered structure or a multi-layered structure. In the case of the multi-layered structure, the individual layers constituting the heat transfer layer may be the same or different in composition.

The resin binder contained in the present invention may be known one. Examples thereof include acrylic resins such as polyacrylonitrile, polyacrylate, and polyacrylamide; polyvinyl acetal resins such as polyvinyl acetoacetal, and polyvinyl butyral; cellulose resins such as ethylcellulose, hydroxyethylcellulose, ethylhydroxycellulose, hydroxypropylcellulose, ethylhydroxyethylcellulose, methylcellulose, cellulose acetate, cellulose acetate butyrate, cellulose acetate propionate, cellulose nitrate, other modified cellulose resins, nitrocellulose, and ethylhydroxyethylcellulose; other resins such as polyurethane resin, polyamide resin, polyester resin, polycarbonate resin, phenoxy resin, phenol resin, and epoxy resin; and various elastomers. The heat transfer layer may be made of at least one resin selected from the above-mentioned group.

These may be used alone, or two or more thereof may be used in the form of a mixture or copolymer. These may be crosslinked with various crosslinking agents.

The binder in the present invention is preferably a cellulose resin or a polyvinyl acetal resin, more preferably a polyvinyl acetal resin. In the present invention, the binder resin is in particular preferably polyvinyl acetoacetal resin, or polyvinyl butyral resin.

In the present invention, a transferable protective layer laminate is preferably formed in area order onto the heat-sensitive transfer sheet. The transferable protective layer laminate is used to protect a heat-transferred image with a protective layer composed of a transparent resin, thereby to improve durability such as scratch resistance, light-fastness, and resistance to weather. This laminate is effective for a case where the transferred dye is insufficient in image durabilities such as light resistance, scratch resistance, and chemical resistance in the state that the dye is naked in the surface of an image-receiving sheet.

The transferable protective layer laminate can be formed by forming, onto a support, a releasing layer, a protective layer and an adhesive layer in this order (i.e., in the layer-described order) successively. The protective layer may be formed by plural layers. In the case where the protective layer also has functions of other layers, the releasing layer and the adhesive layer can be omitted. It is also possible to use a base film on which an easy adhesive layer has already been formed.

As a transferable protective layer-forming resin, preferred are resins that are excellent in scratch resistance, chemical resistance, transparency and hardness. Examples of the resin include polyester resins, polystyrene resins, acrylic resins, polyurethane resins, acrylic urethane resins, silicone-modified resins of the above-described resins, ultraviolet-shielding resins, mixtures of these resins, ionizing radiation-curable resins, and ultraviolet-curing resins. Particularly preferred are polyester resins and acrylic resins. These resins may be crosslinked with various crosslinking agents.

In the heat-sensitive transfer sheet that is used in the present invention, it is preferred to dispose a back side layer on the surface (back side) of the substrate opposite to the thermal transfer layer coating side, namely on the same side as the surface with which a thermal head etc. contacts. In addition, in the case of the protective layer transfer sheet, it is also preferred to dispose a back side layer on the surface (back side) of the substrate opposite to the transferable protective layer coating side, namely on the same side as the surface with which a thermal head etc. contacts.

If the heat-sensitive transfer sheet is heated by a heating device such as a thermal head in the state such that the back side of the support of the transfer sheet directly contacts with the heating device, heat seal is apt to occur. In addition, owing to a large friction between them, it is difficult to smoothly transfer the heat-sensitive transfer sheet at the time of copying.

The back side layer is disposed so that the heat-sensitive transfer sheet enables to withstand heat energy from a thermal head. The back side layer prevents the heat seal, and enables a smooth travel action. In recent years, the necessity of the back side layer is becoming greater on account that the heat energy from a thermal head is increasing in association with speeding-up of the printer.

The back side layer is formed by coating a composition wherein additives such as a sliding agent, a releasing agent, a surfactant, inorganic particles, organic particles, and pigments are added to a binder. Further, an intermediate layer may be disposed between the back side layer and the support. As the intermediate layer, there has been known a layer containing inorganic fine particles and a water-soluble resin or a hydrophilic resin capable of emulsification.

(Image-Forming Method)

In the image-forming method (system) of the present invention, imaging is achieved by superposing a heat-sensitive transfer sheet on a heat-sensitive transfer image-receiving sheet so that a heat transfer layer of the heat-sensitive transfer sheet is in contact with a receptor layer of the heat-sensitive transfer image-receiving sheet and giving thermal energy in accordance with image signals given from a thermal head.

Specifically, image-forming can be achieved by the similar manner to that as described in, for example, JP-A-2005-88545. In the present invention, a printing time is preferably less than 15 seconds, and more preferably in the range of 3 to 12 seconds, and further preferably 3 to 7 seconds, from the viewpoint of shortening a time taken until a consumer gets a print.

In order to accomplish the above-described printing time, a line speed at the time of printing is preferably 1.0 msec/line or less, and further preferably 0.7 msec/line or less. Further, from the viewpoint of improvement in transfer efficiency as one of speeding-up conditions, the maximum ultimate temperature of the thermal head at the time of printing is preferably in the range of from 180° C. to 450° C., more preferably from 200° C. to 450° C., and furthermore preferably from 350° C. to 450° C.

The present invention may be utilized for printers, copying machines and the like, which employs a heat-sensitive transfer recording system. As a means for providing heat energy in the thermal transfer, any of the conventionally known providing means may be used. For example, application of a heat energy of about 5 to 100 mJ/mm$^2$ by controlling recording time in a recording device such as a thermal printer (e.g. trade name: Video Printer VY-100, manufactured by Hitachi, Ltd.), sufficiently attains the expected result.

The present invention can provide an improved heat-sensitive transfer image-receiving sheet that is capable of reducing not only white spots at a low density portion under the conditions of low temperature and low humidity but also uneven density at a high density portion under the conditions of high temperature and high humidity, each of which arises when the conventional heat-sensitive transfer image-receiving sheet is used.

EXAMPLES

The present invention will be described in more detail based on the following examples, but the invention is not intended to be limited thereto. In the following examples, the terms "part(s)" and "%" are values by mass, unless otherwise specified.

Example 1

(Production of Heat-Sensitive Transfer Sheets)

Heat-sensitive transfer sheets were prepared as follows.

A polyester film 6.0 μm in thickness (trade name: Diafoil K200E-6F, manufactured by MITSUBISHI POLYESTER FILM CORPORATION), that was subjected to an easy-adhesion-treatment on one surface of the film, was used as a support. The following back side-layer coating liquid was applied onto the support on the other surface that was not subjected to the easy-adhesion-treatment, so that the coating amount based on the solid content after drying would be 1 g/m$^2$. After drying, the coating liquid was cured by heat at 60° C.

Coating liquids, which will be detailed later, were used to form, onto the easily-adhesive layer painted surface of the thus-formed polyester film, individual heat-sensitive transfer layers in yellow, magenta and cyan, and a transferable protective layer laminate in area order by painting. In this way, a heat-sensitive transfer sheet was produced. The solid coating amount in each of the heat-sensitive transfer layers (dye layers) was set to 0.8 g/m$^2$.

In the formation of the transferable protective layer laminate, a releasing-liquid-coating liquid was painted, a protective-layer-coating liquid was painted thereon, the resultant was dried, and then an adhesive-layer-coating liquid was painted thereon.

| Back side layer-coating liquid | |
|---|---|
| Acrylic polyol resin (trade name: ACRYDIC A-801, manufactured by Dainippon Ink and Chemicals, Incorporated) | 28.0 mass parts |
| Zinc stearate (trade name: SZ-2000, manufactured by Sakai Chemical Industry Co., Ltd.) | 0.45 mass part |
| Phosphate ester (trade name: PLYSURF A217, manufactured by Dai-ichi Kogyo Seiyaku Co., Ltd.) | 1.30 mass parts |
| Polyisocyanate (trade name: BURNOCK D-800, manufactured by Dainippon Ink and Chemicals, Incorporated) | 8.3 mass parts |
| Methyl ethyl ketone/Toluene (2/1, at mass ratio) | 72 mass parts |

| Yellow-dye-layer-coating liquid | |
|---|---|
| Dye (Y-1) | 4.3 mass parts |
| Dye (Y-2) | 3.6 mass parts |
| Polyvinylacetal resin (trade name: DENKA BUTYRAL #6000-AS, manufactured by DENKI KAGAKU KOGYOU K. K.) | 5.5 mass parts |

-continued

| Yellow-dye-layer-coating liquid | |
|---|---|
| Polyvinylacetal resin (trade name: DENKA BUTYRAL #6000-CS, manufactured by DENKI KAGAKU KOGYOU K. K.) | 3.0 mass parts |
| Matting agent (trade name: Flo-thene UF, manufactured by Sumitomo Seika Chemicals Co., Ltd.) | 0.13 mass part |
| Methyl ethyl ketone/Toluene (2/1, at mass ratio) | 85 mass parts |

Y-1

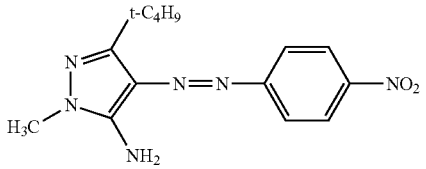

Y-2

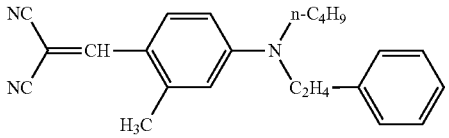

| Magenta-dye-layer-coating liquid | |
|---|---|
| Dye (M-1) | 0.6 mass part |
| Dye (M-2) | 0.6 mass part |
| Dye (M-3) | 5.9 mass parts |
| Polyvinylacetal resin (trade name: DENKA BUTYRAL #6000-AS, manufactured by DENKI KAGAKU KOGYOU K. K.) | 6.5 mass parts |
| Polyvinylacetal resin (trade name: DENKA BUTYRAL #6000-CS, manufactured by DENKI KAGAKU KOGYOU K. K.) | 1.0 mass parts |
| Matting agent (trade name: Flo-thene UF, manufactured by Sumitomo Seika Chemicals Co., Ltd.) | 0.13 mass part |
| Methyl ethyl ketone/Toluene (2/1, at mass ratio) | 85 mass parts |

M-1

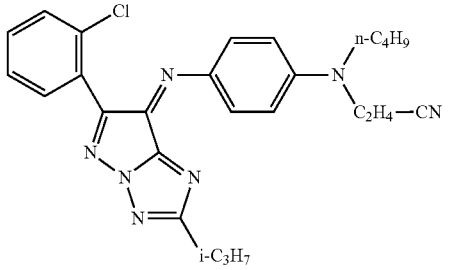

M-2

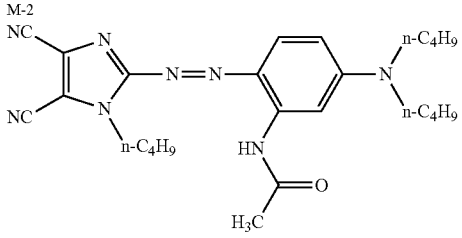

-continued

| Magenta-dye-layer-coating liquid | |
|---|---|
| M-3 | |

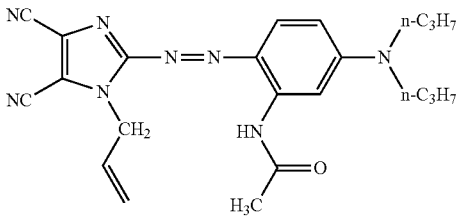

| Cyan-dye-layer-coating liquid | |
|---|---|
| Dye (C-1) | 1.2 mass part |
| Dye (C-2) | 6.9 mass parts |
| Polyvinylacetal resin (trade name: DENKA BUTYRAL #6000-AS, manufactured by DENKI KAGAKU KOGYOU K. K.) | 7.0 mass parts |
| Polyvinylacetal resin (trade name: DENKA BUTYRAL #6000-CS, manufactured by DENKI KAGAKU KOGYOU K. K.) | 1.5 mass part |
| Matting agent (trade name: Flo-thene UF, manufactured by Sumitomo Seika Chemicals Co., Ltd.) | 0.12 mass part |
| Methyl ethyl ketone/Toluene (2/1, at mass ratio) | 85 mass parts |

C-1

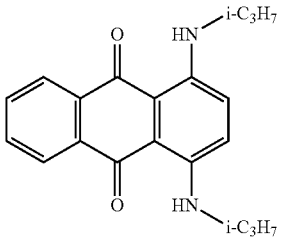

C-2

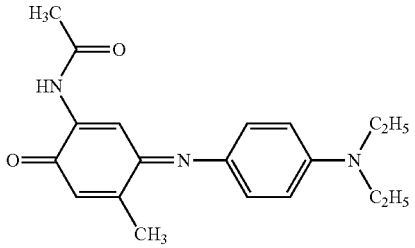

(Transfer Protective Layer Laminate)

On the polyester film coated with the dye layers as described above, coating solutions of a releasing layer, a protective layer and an adhesive layer each having the following composition was coated, to form a transfer protective layer laminate. Coating amounts of the releasing layer, the protective layer and the adhesive layer after drying were 0.5 g/m$^2$, 1.0 g/m$^2$ and 1.8 g/m$^2$, respectively.

| Releasing-layer-coating liquid | |
|---|---|
| Modified cellulose resin (trade name: L-30, manufactured by DAICEL CHEMICAL INDUSTRIES, LTD.) | 4.8 mass parts |
| Methyl ethyl ketone | 95.0 mass parts |
| **Protective-layer-coating liquid** | |
| Acrylic resin (trade name: DIANAL BR-100, manufactured by MITSUBISHI RAYON CO., LTD.) | 32 mass parts |
| Isopropanol | 75 mass parts |
| **Adhesive-layer-coating liquid** | |
| Acrylic resin (trade name: DIANAL BR-77, manufactured by MITSUBISHI RAYON CO., LTD.) | 25 mass parts |
| The following ultraviolet absorber UV-1 | 1.5 mass parts |
| The following ultraviolet absorber UV-2 | 1.5 mass parts |
| The following ultraviolet absorber UV-3 | 1.0 mass parts |
| The following ultraviolet absorber UV-4 | 1.0 mass part |
| Silicone-based resin fine particles (trade name: TOSPEARL 120, manufactured by MOMENTIVE Performance Materials Japan LLC.) | 0.07 mass part |
| Methyl ethyl ketone/toluene (2/1, at mass ratio) | 70 mass parts |

(UV-1)

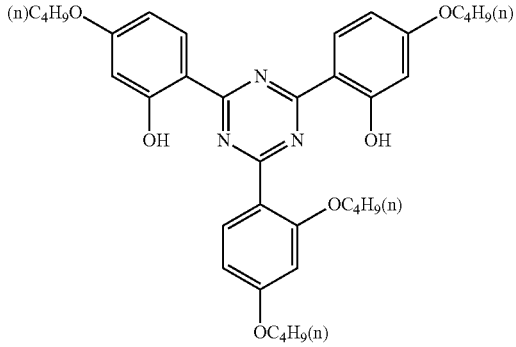

(UV-2)

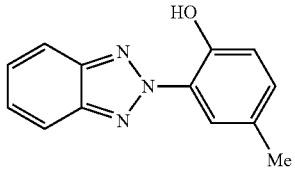

(UV-3)

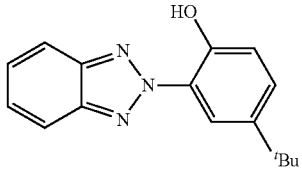

(UV-4)

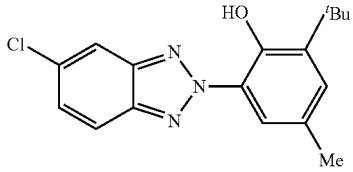

[Preparation of Heat-Sensitive Transfer Image-Receiving Sheet]

[Preparation of Heat-Sensitive Transfer Image-Receiving Sheet 1: Comparative Example]

Sample 302 that is described in Example of JP-A-2007-237613 was prepared. The thus prepared sample was designated as the heat-sensitive transfer image-receiving sheet 1.

[Preparation of Heat-Sensitive Transfer Image-Receiving Sheet 2: Comparative Example]

The heat-sensitive transfer image-receiving sheet 2 was prepared as follows.

A paper support, on both sides of which polyethylene was laminated, was subjected to corona discharge treatment on the surface thereof, and then a gelatin undercoat layer containing sodium dodecylbenzenesulfonate was disposed on the treated surface. The intermediate layer, the heat insulation layer and the receptor layer each having the following composition were simultaneously multilayer-coated on the gelatin undercoat layer, in the state that the intermediate layer, the heat insulation layer and the receptor layer were laminated in this order from the side of the support. The coating was performed so that coating amounts of the intermediate layer, the heat insulation layer and the receptor layer after drying would be 6.5 g/m$^2$, 7.2 g/m$^2$ and 2.6 g/m$^2$, respectively. The following compositions are expressed by mass as a solid content.

To each layer, 1,2-benzisothiazoline-3-on was added in each amount of 500 ppm with respect to the amount by weight of the each layer-coating liquid. To the intermediate layer-coating liquid, 2,4-dichloro-6-hydroxy-s-triazine hardening agent was added so as to become a coating amount of 3% with respect to the total coating amount of gelatin.

| Receptor-layer coating-liquid | |
|---|---|
| Vinyl chloride-based latex (Tg = 70° C.) (trade name: Vinybran 900, manufactured by Nisshin Chemicals Co., Ltd.) | 32.0 mass parts |
| Vinyl chloride-based latex (Tg = 46° C.) (trade name: Vinybran 690, manufactured by Nisshin Chemicals Co., Ltd.) | 54.0 mass parts |
| Gelatin (10% solution) | 2.1 mass parts |
| The following ester-based wax EW-1 | 7.9 mass parts |
| Polymer having a fluoro aliphatic group at a side chain (trade name: Megafac F-472SF, manufactured by Dainippon Ink & Chemicals Incorporated) | 2.7 mass parts |
| The following surfactant F-1 | 0.2 mass part |
| The following surfactant F-2 | 1.1 mass part |

(EW-1)

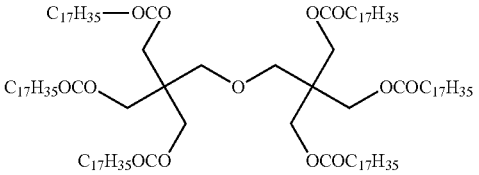

(F-1)

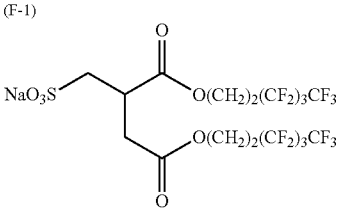

(F-2)

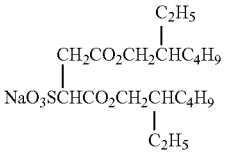

| Heat insulation layer-coating liquid | |
|---|---|
| Hollow latex polymer particles (trade name: MH5055, manufactured by Nippon Zeon Co., Ltd.) | 68.0 mass parts |
| Gelatin (10% solution) | 32.0 mass parts |

| Intermediate layer-coating liquid | |
|---|---|
| Polyvinyl alcohol (POVAL PVA205: trade name, manufactured by Kuraray) | 12.0 mass parts |
| Methyl methacrylate/butadiene latex (Tg = −5° C., average particle size 0.2 μm) (MR-171; trade name, manufactured by Nippon A&L Inc) | 95.0 mass parts |

[Preparation of Heat-Sensitive Transfer Image-Receiving Sheet 3: Comparative Example]

The heat-sensitive transfer image-receiving sheet 3 was prepared as follows.

A paper support, on both sides of which polyethylene was laminated, was subjected to corona discharge treatment on the surface thereof, and then a gelatin undercoat layer containing sodium dodecylbenzenesulfonate was disposed on the treated surface. The intermediate layer, the heat insulation layer, the lower receptor layer and the upper receptor layer each having the following composition were simultaneously multilayer-coated on the gelatin undercoat layer, in the state that the intermediate layer, the heat insulation layer, the lower receptor layer and the upper receptor layer were laminated in this order from the side of the support, by the same manner as in the heat-sensitive transfer image-receiving sheet 2. The coating was performed so that coating amounts of the intermediate layer, the heat insulation layer, the lower receptor layer and the upper receptor layer after drying would be 6.5 g/m$^2$, 7.2 g/m$^2$, 4.8 g/m$^2$ and 2.6 g/m$^2$, respectively. The following compositions are expressed by mass as a solid content.

To each layer, 1,2-benzisothiazoline-3-on was added in each amount of 500 ppm with respect to the amount by weight of the each layer-coating liquid. To the intermediate layer-coating liquid, 2,4-dichloro-6-hydroxy-s-triazine hardening agent was added so as to become a coating amount of 3% with respect to the total coating amount of gelatin.

| Upper receptor-layer coating-liquid | |
|---|---|
| Vinyl chloride-based latex (Tg = 70° C.) (trade name: Vinybran 900, manufactured by Nisshin Chemicals Co., Ltd.) | 32.0 mass parts |
| Vinyl chloride-based latex (Tg = 46° C.) (trade name: Vinybran 690, manufactured by Nisshin Chemicals Co., Ltd.) | 54.0 mass parts |
| Gelatin (10% solution) | 2.1 mass parts |
| The ester-based wax EW-1 | 7.9 mass parts |
| Polymer having a fluoro aliphatic group at a side chain (trade name: Megafac F-472SF, manufactured by Dainippon Ink & Chemicals Incorporated) | 2.7 mass parts |
| The surfactant F-1 | 0.2 mass part |
| The surfactant F-2 | 1.1 mass part |

| Lower receptor-layer coating-liquid | |
|---|---|
| Vinyl chloride-based latex (Tg = 46° C.) (trade name: Vinybran 690, manufactured by Nisshin Chemicals Co., Ltd.) | 52.0 mass parts |
| Gelatin (10% solution) | 5.0 mass parts |

| Heat insulation layer-coating liquid | |
|---|---|
| Hollow latex polymer particles (void ratio: 26%; average particle size 0.5 μm) (trade name: MH5055, manufactured by Nippon Zeon Co., Ltd.) | 68.0 mass parts |
| Gelatin (10% solution) | 32.0 mass parts |

| Intermediate layer-coating liquid | |
|---|---|
| Polyvinyl alcohol (POVAL PVA205: trade name, manufactured by Kuraray) | 12.0 mass parts |
| Methyl methacrylate/butadiene latex (Tg = −5° C., average particle size 0.2 μm) (MR-171; trade name, manufactured by Nippon A&L Inc) | 90.0 mass parts |

[Preparation of Heat-Sensitive Transfer Image-Receiving Sheet 4: Comparative Example]

The heat-sensitive transfer image-receiving sheet 4 was prepared as follows.

A paper support, on both sides of which polyethylene was laminated, was subjected to corona discharge treatment on the surface thereof, and then a gelatin undercoat layer containing sodium dodecylbenzenesulfonate was disposed on the treated surface. The intermediate layer, the heat insulation layer, the lower receptor layer and the upper receptor layer each having the following composition were simultaneously multilayer-coated on the gelatin undercoat layer, in the state that the intermediate layer, the heat insulation layer, the lower receptor layer and the upper receptor layer were laminated in this order from the side of the support, by the same manner as in the heat-sensitive transfer image-receiving sheet 2. The coating was performed so that coating amounts of the intermediate layer, the heat insulation layer, the lower receptor layer and the upper receptor layer after drying would be 6.5 $g/m^2$, 7.2 $g/m^2$, 4.8 $g/m^2$ and 2.6 $g/m^2$, respectively. The following compositions are expressed by mass as a solid content.

To each layer, 1,2-benzisothiazoline-3-on was added in each amount of 500 ppm with respect to the amount by weight of the each layer-coating liquid. To the intermediate layer-coating liquid, 2,4-dichloro-6-hydroxy-s-triazine hardening agent was added so as to become a coating amount of 3% with respect to the total coating amount of gelatin.

| Upper receptor-layer coating-liquid | |
|---|---|
| Vinyl chloride-based latex (Tg = 70° C.) (trade name: Vinybran 900, manufactured by Nisshin Chemicals Co., Ltd.) | 32.0 mass parts |
| Vinyl chloride-based latex (Tg = 46° C.) (trade name: Vinybran 690, manufactured by Nisshin Chemicals Co., Ltd.) | 54.0 mass parts |

-continued

| Upper receptor-layer coating-liquid | |
|---|---|
| Hollow polymer particles latex particle (void ratio: 55%, average particle diameter 1.0 μm) (trade name: Rohpake HP-1055, manufactured by Rohm and Haas Co.) | 46.0 mass parts |
| Gelatin (10% solution) | 2.1 mass parts |
| The ester-based wax EW-1 | 7.9 mass parts |
| Polymer having a fluoro aliphatic group at a side chain (trade name: Megafac F-472SF, manufactured by Dainippon Ink & Chemicals Incorporated) | 2.7 mass parts |
| The surfactant F-1 | 0.2 mass part |
| The surfactant F-2 | 1.1 mass part |

| Lower receptor-layer coating-liquid | |
|---|---|
| Vinyl chloride-based latex (Tg = 46° C.) (trade name: Vinybran 690, manufactured by Nisshin Chemicals Co., Ltd.) | 52.0 mass parts |
| Gelatin (10% solution) | 5.0 mass parts |
| Hollow latex polymer particles (void ratio: 55%, average particle diameter 1.0 μm) (trade name: Rohpake HP-1055, manufactured by Rohm and Haas Co.) | 46.0 mass parts |

| Heat insulation layer-coating liquid | |
|---|---|
| Hollow latex polymer particles (void ratio: 26%; average particle size 0.5 μm) (trade name: MH5055, manufactured by Nippon Zeon Co., Ltd.) | 68.0 mass parts |
| Gelatin (10% solution) | 32.0 mass parts |

| Intermediate layer-coating liquid | |
|---|---|
| Polyvinyl alcohol (POVAL PVA205: trade name, manufactured by Kuraray) | 12.0 mass parts |
| Methyl methacrylate/butadiene latex (Tg = −5° C., average particle size 0.2 μm) (MR-171; trade name, manufactured by Nippon A&L Inc) | 90.0 mass parts |

[Preparation of Heat-Sensitive Transfer Image-Receiving Sheet 5: This Invention]

The heat-sensitive transfer image-receiving sheet 5 was prepared as follows.

A paper support, on both sides of which polyethylene was laminated, was subjected to corona discharge treatment on the surface thereof, and then a gelatin undercoat layer containing sodium dodecylbenzenesulfonate was disposed on the treated surface. The intermediate layer, the heat insulation layer, the lower receptor layer and the upper receptor layer each having the following composition were simultaneously multilayer-coated on the gelatin undercoat layer, in the state that the intermediate layer, the heat insulation layer, the lower receptor layer and the upper receptor layer were laminated in this order from the side of the support, by the same manner as in the heat-sensitive transfer image-receiving sheet 2. The coating was performed so that coating amounts of the intermediate layer, the heat insulation layer, the lower receptor layer and the upper receptor layer after drying would be 6.5 g/m$^2$, 7.2 g/m$^2$, 4.8 g/m$^2$ and 2.6 g/m$^2$, respectively. The following compositions are expressed by mass as a solid content.

To each layer, 1,2-benzisothiazoline-3-on was added in each amount of 500 ppm with respect to the amount by weight of the each layer-coating liquid. To the intermediate layer-coating liquid, 2,4-dichloro-6-hydroxy-s-triazine hardening agent was added so as to become a coating amount of 3% with respect to the total coating amount of gelatin.

| Upper receptor-layer coating-liquid | |
|---|---|
| Vinyl chloride-based latex (Tg = 70° C.) (trade name: Vinybran 900, manufactured by Nisshin Chemicals Co., Ltd.) | 32.0 mass parts |
| Vinyl chloride-based latex (Tg = 46° C.) (trade name: Vinybran 690, manufactured by Nisshin Chemicals Co., Ltd.) | 54.0 mass parts |
| Gelatin (10% solution) | 2.1 mass parts |
| The ester-based wax EW-1 | 7.9 mass parts |
| Polymer having a fluoro aliphatic group at a side chain (trade name: Megafac F-472SF, manufactured by Dainippon Ink & Chemicals Incorporated) | 2.7 mass parts |
| The surfactant F-1 | 0.2 mass part |
| The surfactant F-2 | 1.1 mass part |

| Lower receptor-layer coating-liquid | |
|---|---|
| Vinyl chloride-based latex (Tg = 46° C.) (trade name: Vinybran 690, manufactured by Nisshin Chemicals Co., Ltd.) | 52.0 mass parts |
| Gelatin (10% solution) | 5.0 mass parts |
| Hollow latex polymer particles (void ratio: 55%, average particle diameter 1.0 μm) (trade name: Rohpake HP-1055, manufactured by Rohm and Haas Co.) | 46.0 mass parts |

| Heat insulation layer-coating liquid | |
|---|---|
| Hollow latex polymer particles (void ratio: 26%; average particle size 0.5 μm) (trade name: MH5055, manufactured by Nippon Zeon Co., Ltd.) | 68.0 mass parts |
| Gelatin (10% solution) | 32.0 mass parts |

| Intermediate layer-coating liquid | |
|---|---|
| Polyvinyl alcohol (POVAL PVA205: trade name, manufactured by Kuraray) | 12.0 mass parts |
| Methyl methacrylate/butadiene latex (Tg = −5° C., average particle size 0.2 μm) (MR-171; trade name, manufactured by Nippon A&L Inc) | 90.0 mass parts |

[Preparation of Heat-Sensitive Transfer Image-Receiving Sheet 6: This Invention]

The heat-sensitive transfer image-receiving sheet 6 was prepared in the same manner as the heat-sensitive transfer image-receiving sheet 5, except for altering the lower receptor layer as follows.

| Lower receptor-layer coating-liquid | |
|---|---|
| Vinyl chloride-based latex (Tg = 33° C.) (trade name: Vinybran 276, manufactured by Nisshin Chemicals Co., Ltd.) | 90.0 mass parts |
| Gelatin (10% solution) | 5.0 mass parts |
| Hollow polymer latex particles (void ratio: 55%, average particle diameter 1.0 μm) (trade name: Rohpake HP-1055, manufactured by Rohm and Haas Co.) | 46.0 mass parts |

[Preparation of Heat-Sensitive Transfer Image-Receiving Sheet 7: This Invention]

The heat-sensitive transfer image-receiving sheet 7 was prepared in the same manner as the heat-sensitive transfer image-receiving sheet 5, except for altering the lower receptor layer as follows.

| Lower receptor-layer coating-liquid | |
|---|---|
| Polyester-based latex (Tg = 40° C.) (trade name: VYRONAL MD-1100, manufactured by Toyobo) | 64.0 mass parts |
| Gelatin (10% solution) | 5.0 mass parts |
| Hollow latex polymer particles (void ratio: 55%, average particle diameter 1.0 μm) (trade name: Rohpake HP-1055, manufactured by Rohm and Haas Co.) | 46.0 mass parts |

[Preparation of Heat-Sensitive Transfer Image-Receiving Sheet 8: This Invention]

The heat-sensitive transfer image-receiving sheet 8 was prepared in the same manner as the heat-sensitive transfer image-receiving sheet 5, except for altering the upper receptor layer and intermediate layer as follows.

| Upper receptor-layer coating-liquid | |
|---|---|
| Vinyl chloride-based latex (Tg = 70° C.) (trade name: Vinybran 900, manufactured by Nisshin Chemicals Co., Ltd.) | 10.0 mass parts |
| Polyester-based latex (Tg = 40° C.) (trade name: VYRONAL MD-1100, manufactured by Toyobo) | 120.0 mass parts |
| Gelatin (10% solution) | 2.1 mass parts |
| The ester-based wax EW-1 | 7.9 mass parts |
| Polymer having a fluoro aliphatic group at a side chain (trade name: Megafac F-472SF, manufactured by Dainippon Ink & Chemicals Incorporated) | 2.7 mass parts |
| The surfactant F-1 | 0.2 mass part |
| The surfactant F-2 | 1.1 mass part |

| Intermediate layer-coating liquid | |
|---|---|
| Polyvinyl alcohol (POVAL PVA205: trade name, manufactured by Kuraray) | 12.0 mass parts |
| Styrene/butadiene based latex (Tg = −5° C., average particle size 0.2 μm) (SR-103; trade name, manufactured by Nippon A&L Inc) | 90.0 mass parts |
| The surfactant F-1 | 0.05 mass part |

(Evaluation)

(Evaluation of White Spots Under the Conditions of Low Temperature and Low Humidity)

As a printer for evaluation of the image-forming method, a Fuji Film thermal photoprinter ASK-2000 L (trade name, manufactured by FUJIFILM Corporation) was used. The heat-sensitive transfer sheet, the heat-sensitive transfer image-receiving sheet and the printer as described above were placed under the environmental conditions of temperature: 15° C. and humidity: 20% for 24 hours. After that, images each having a size of 127 mm×89 mm were successively output in total of 10 sheets under the same conditions. The presence or not of white spots on the output image was evaluated according to the ranking set forth below. The kinds of the images were a figure (indoor), a figure (outdoor), a landscape, a still life and a gray solid image (gray density 0.3). Using 2 sheets of each image, organoleptic evaluation was performed by 10 testers. The evaluation results were indicated by an average value of the evaluated ranks.

Evaluation Rank for White Spot

5: No white spot was detected.

4: Some white spots were detected but only to the degree allowing appreciation of image without difficulty.

3: White spots prohibited appreciation of image, depending on the kind of image.

2: White spots prohibited appreciation of image regardless of the kind of image.

1: Many white spots were detected, apparently resulting in decrease in overall image density.

(Evaluation of Uneven Density Under the Conditions of High Temperature and High Humidity)

As a printer for evaluation of the image-forming method, a Fuji Film thermal photoprinter ASK-4000 A (trade name, manufactured by FUJIFILM Corporation) was used. The heat-sensitive transfer sheet, the heat-sensitive transfer image-receiving sheet and the printer as described above were placed under the environmental conditions of temperature: 30° C. and humidity: 80% for 24 hours. After that, A4 size images were successively output in total of 3 sheets under the same conditions. Uneven density on the output image was evaluated according to the ranking set forth below. The kinds of the images were a figure (indoor), a figure (outdoor), a landscape, a still life and a gray solid image (gray density 0.3). Using 2 sheets of each image, organoleptic evaluation was performed by 10 testers. The evaluation results were indicated by an average value of the evaluated ranks.

Evaluation Rank for Uneven Density

5. The uneven density is not found in the image at all.

4. The uneven density is found in an extremely small part of the image, and is not an obstacle to appreciation.

3. The uneven density is an obstacle to appreciation with respect to the particular kind of image.

2. The uneven density is an obstacle to appreciation irrespective of the kind of image.

1. The uneven density is so remarkable that the image looks like a change of color.

TABLE 1

| Heat-sensitive transfer image-receiving sheet No. | Evaluation rank for white spot | Evaluation rank for uneven density | Remarks |
|---|---|---|---|
| 1 | 1.9 | 1.8 | Comparative Example |
| 2 | 2.5 | 2.3 | Comparative Example |
| 3 | 2.9 | 2.7 | Comparative Example |
| 4 | 1.2 | 1.1 | Comparative Example |
| 5 | 4.9 | 4.8 | This invention |
| 6 | 4.9 | 4.8 | This invention |
| 7 | 4.6 | 4.6 | This invention |
| 8 | 4.3 | 4.5 | This invention |

As is apparent from the results set forth above, it is possible to provide a high image quality heat-sensitive transfer image-receiving sheet free of not only the white spots at a low density portion under the conditions of low temperature and low humidity, but also the uneven density at a high density portion under the conditions of high temperature and high humidity according to the present invention.

Having described our invention as related to the present embodiments, it is our intention that the invention not be limited by any of the details of the description, unless otherwise specified, but rather be construed broadly within its spirit and scope as set out in the accompanying claims.

This non-provisional application claims priority under 35 U.S.C.§119 (a) on Patent Application No. 2008-019859 filed in Japan on Jan. 30, 2008, which is entirely herein incorporated by reference.

What we claim is:

1. A heat-sensitive transfer image-receiving sheet comprising a heat insulation layer containing hollow polymeric particles, and at least two layers of receptor layers, coated in this order on one surface of a support, the receptor layer nearest from the support containing hollow polymeric particles and a latex polymer, and the receptor layer furthest from the support containing no hollow polymeric particles but a latex polymer.

2. The heat-sensitive transfer image-receiving sheet according to claim 1, wherein the receptor layer nearest from the support is adjacent to the heat insulation layer.

3. The heat-sensitive transfer image-receiving sheet according to claim 1, wherein the solid content by mass of the hollow polymeric particles contained in the heat insulation layer is in the range of 75% to 95% of the total solid content by mass of the heat insulation layer, and the solid content by mass of the hollow polymeric particles contained in the receptor layer nearest from the support is in the range of 10% to 70% of the total solid content by mass of the receptor layer.

4. The heat-sensitive transfer image-receiving sheet according to claim 1, wherein the average particle size of the hollow polymeric particles contained in the heat insulation layer is in the range of 0.1 μm to 3.0 μm, and the average particle size of the hollow polymeric particles contained in the receptor layer nearest from the support is in the range of 0.6 μm to 5.0 μm.

5. The heat-sensitive transfer image-receiving sheet according to claim 1, wherein the receptor layer furthest from the support contains a vinyl chloride-based latex copolymer, and the glass transition temperature (Tg) of a resin forming the latex polymer is in the range of 15° C. to 65° C., the latex polymer being contained in the receptor layer nearest from the support.

6. The heat-sensitive transfer image-receiving sheet according to claim 1, wherein the ratio of the solid content by mass of hollow polymeric particles/latex polymer in the receptor layer nearest from the support is in the range of 0.1 to 3.5.

7. The heat-sensitive transfer image-receiving sheet according to claim 1, wherein each of the heat insulation layer, the receptor layer nearest from the support and the receptor layer furthest from the support contains a water-soluble polymer.

8. The heat-sensitive transfer image-receiving sheet according to claim 7, wherein the solid content by mass of the water-soluble polymer contained in the heat insulation layer is in the range of 2% to 50% of the total solid content by mass of the heat insulation layer, the solid content by mass of the water-soluble polymer contained in the receptor layer nearest from the support is in the range of 0.2% to 10% of the total solid content by mass of the receptor layer, and the solid content by mass of the water-soluble polymer contained in the receptor layer furthest from the support is in the range of 0.1% to 3.0% of the total solid content by mass of the receptor layer.

* * * * *